United States Patent [19]

Hayes

[11] 4,374,569

[45] Feb. 22, 1983

[54] FURNACE DRAFT CONTROL SYSTEM WITH ELECTRONIC LOSS-OF-DRAFT TIMER

[75] Inventor: Thomas E. Hayes, Goshen, Ind.

[73] Assignee: Johnson Controls, Inc., Milwaukee, Wis.

[21] Appl. No.: 288,109

[22] Filed: Jul. 29, 1981

[51] Int. Cl.[3] ..... F23N 3/00

[52] U.S. Cl. ..... 236/1 G; 431/20

[58] Field of Search ..... 236/1 G, 15 C; 431/20, 431/6; 110/163

[56] References Cited

U.S. PATENT DOCUMENTS 4,189,296 2/1980 Hayes ..... 431/20

4,239,477 12/1980 Hayes ..... 431/20

*Primary Examiner*—Albert J. Makay

*Assistant Examiner*—Harry Tanner

*Attorney, Agent, or Firm*—Emrich, Lee, Brown & Hill

[57] ABSTRACT

The system includes a damper plate equipped with a draft controller or sensing switch and a motor for positioning the damper plate to control the furnace draft. Upon generation of a call-for-heat signal, an initialization signal drives the damper off its closed position. From then on, draft must be sensed by the draft controller switch to complete the cycle to open the damper plate. When the damper plate is fully opened, a fuel and ignition control circuit is energized to supply fuel to the furnace, and an electronic timer is energized to generate a signal which establishes a trial-for-draft period. When the fuel is ignited, the draft will increase and energize the motor to move the damper plate off the fully open position during the trial-for-draft period, and thereafter, the position of the damper plate is controlled by the draft controller switch to achieve a proper draft within design range. If draft is lost at any time, the controller moves the damper to the full open position and a loss-of-draft safety timing period commences. If draft is not re-established during this period, the system shuts off the fuel and locks out. When the call for heat is satisfied, the system closes the damper and is prepared for another operating cycle. All operating elements, both electronic and mechanical, are tested in a full operating cycle because operation of a subsequent cycle cannot commence unless the damper plate is returned to the fully closed position which also reduces heat loss during periods of non-use. A failure of any component locks the system out.

8 Claims, 1 Drawing Figure

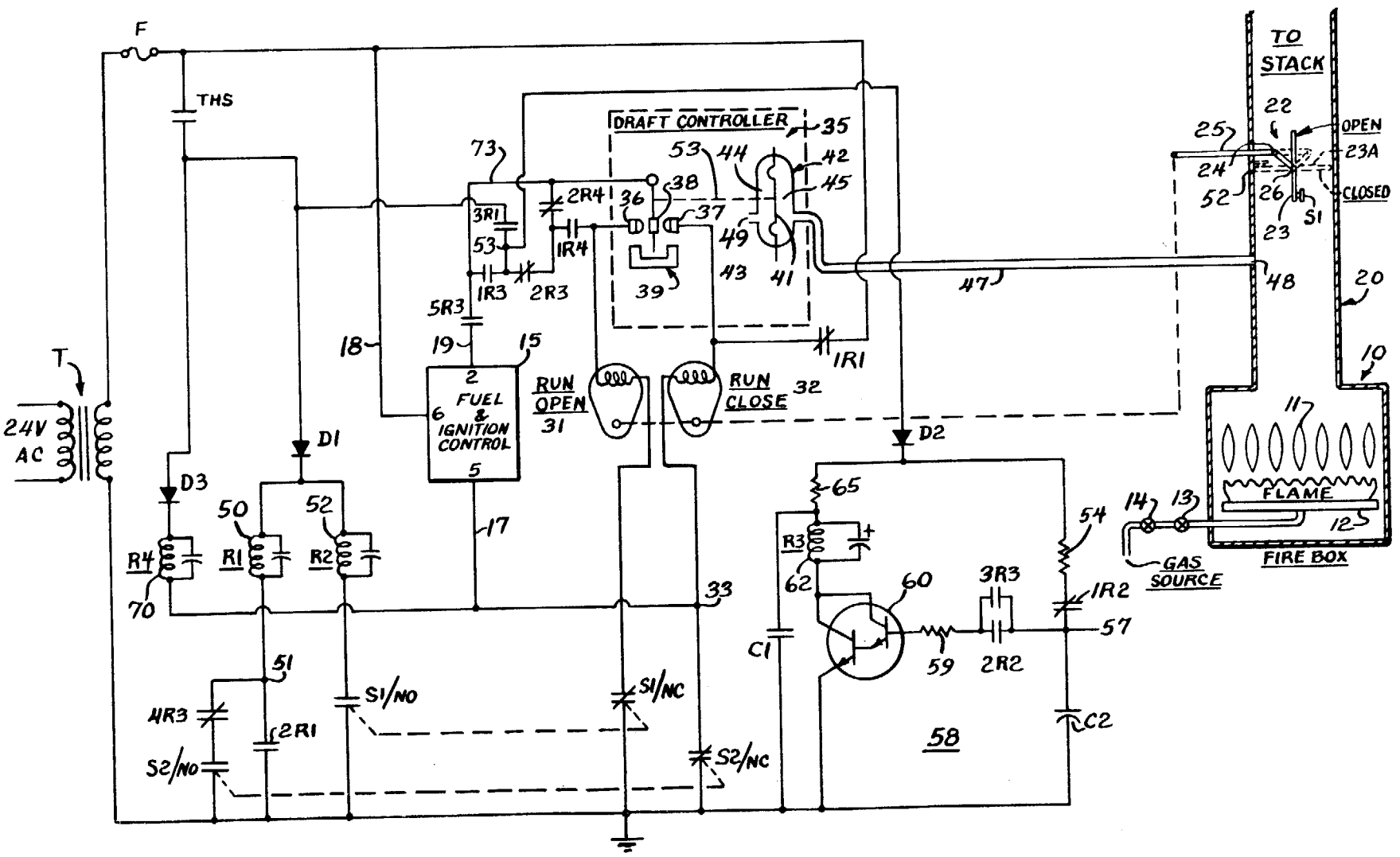
TO STACK
OPEN
23A
CLOSED
FLAME
FIRE BOX
GAS SOURCE
DRAFT CONTROLLER
RUN CLOSE
RUN OPEN
FUEL & IGNITION CONTROL
THS
24V AC

FURNACE DRAFT CONTROL SYSTEM WITH ELECTRONIC LOSS-OF-DRAFT TIMER

BACKGROUND AND SUMMARY

The present invention relates to furnace ignition systems in general; and in particular, it relates to an ignition system for a fuel-burning appliance or furnace which eliminates the need of a conventional draft hood.

In addition to performing the functions of a conventional draft hood, the present invention also provides a stack damper when the appliance is off, controls the value of draft while the appliance is operating, establishes that there is no blockage of the flue before turning the fuel on, and provides loss-of-draft safety by shutting off the source of fuel if draft is lost and cannot be re-established within a predetermined time after the damper has been driven to the full open position. The loss-of-draft period is determined by an electronic circuit.

Draft hoods have been used with gas-fired appliances such as furnaces, water heaters, and the like for many years. A draft hood is a fitting which is normally located in the flue pipe leading from the appliance to the vent stack, or in the stack itself, which vents the combustion products from the fire box of the appliance to a chimney.

A draft hood serves a number of purposes in an installation of this type. In the case of a down draft or stoppage anywhere in the flue or stack beyond the draft hood, it permits the escape of combustion products into the ambient. A draft hood also neutralizes the effect of stack action of the chimney on the operation of the appliance by drawing air from the ambient and exhausting it through the chimney when the appliance is first fired.

Even though draft hoods have long been known to constitute a major heat loss to the outside, both when the furnace is being fired and when it is not, nevertheless, they have been widely used because the cost of fuel had previously been relatively low and because any alternative, particularly in residential usage, did not provide the degree of safety and reliability for the various conditions encountered in operation for a typical residential furnace.

Even with the advent of substantial increases in fuel cost, draft hoods have continued in use because of the difficulties in providing a system which accomplishes all of the purposes of a draft hood in a safe and reliable manner, and which does not require an expenditure on the part of the home owner for purchase and installation, which would not be offset by the savings in the cost of fuel.

The present invention provides an ignition and control system for a furnace which eliminates the need for a conventional draft hood while, at the same time, providing a stack damper when the furnace is off, controlling the value of draft when the furnace is fired, and shutting the furnace down in the event that draft is lost during any portion of the operating cycle. All of these functions and features are accomplished in a system which is economical to purchase and install, and which is safe for residential use.

Briefly, the present invention includes a damper plate which is movable under control between a closed and an open position. When a call-for-heat signal is generated, as by the closing of thermostat contacts in the room being heated by the furnace, the damper plate must be in the fully closed position or the system will not start. By returning the damper plate to the fully closed position at the end of each heating cycle, as will be more fully understood after reviewing this disclosure of the invention, all of the major mechanical and electronic components are proved and shown to be operative. Thus, a call-for-heat signal energizes a holding relay which, in turn, energizes a "run open" motor to move the damper off the fully closed position. At the same time, an initialization relay is energized to insure that the "run open" motor continues to be energized until the damper reaches the full open position, at which time the "run open" motor is de-energized, and a timer enable relay is energized.

The actuation of the timer enable relay energizes an electronic timer circuit for a predetermined time referred to as a "trial-for-draft". It is during this trial-for-draft period that an actual draft must be established as sensed by the draft controller, or the system will shut down. The timer circuit energizes an enable ignition relay during the trial-for-draft period, and it also enables the draft controller to be placed in operative circuit relation with the drive motors. This enable ignition relay energizes a fuel and ignition control circuit which permits fuel to flow through the main burner and also causes ignition.

Following the ignition of the fuel, a substantial draft will normally be created, causing the draft controller to energize a "run close" motor, thereby moving the damper plate off the full open position. Operation of the damper then continues under control of the draft controller so that the amount of draft is within design range. If at the end of the trial-for-draft period, the damper remains in the open position, indicating draft has not been established beyond a predetermined value, the system shuts off the fuel and locks out.

Once draft is established during the trial-for-draft period, the predetermined draft values define a desired draft range in which the system considers the amount of draft to be normal. If draft is less than a first value, a first switch within the Draft Controller energizes a damper motor to move the damper in the open direction to increase flow; and if draft is greater than a second value, a second switch within the Draft Controller energizes a damper motor to move the damper in the closing direction until a draft value is established within the design draft range. Either a single reversible motor can be used to actuate the damper, or, as in the case of the illustrated embodiment, separate motors can be used, each being actuated to rotate in a different direction to open and close the damper.

If neither of the draft controller switches is closed, the damper motor is de-energized, and this indicates that the draft value is within the design range. Hence, the damper remains at rest as long as draft is within the design range. If draft is lost, the system moves the damper to the full open position, and a loss-of-draft safety timing period commences. If draft is not re-established during this safety timing period, the system shuts off the fuel and locks itself out.

When the call for heat is satisfied, the system closes the damper and is prepared for another operating cycle, having tested the operativeness of all major components without failure. Any failure would have locked the system out. The various safety features of the system can only be understood in light of the particular circuitry of the system; and they will be described after the system is disclosed in detail. Of particular interest is the fact that in no instance will a single component failure permit a condition in which the damper plate is closed and the fuel and ignition circuit is energized. Also, during the trial-for-ignition, only an actual draft created by air flow can move the damper off the full open position and thereby avoid shut off. No draft during this period would indicate a blocked flue.

Other features and advantages of the present invention will be apparent from the following detailed description accompanied by the attached drawing.

THE DRAWING

The drawing is a schematic diagram, partly in functional block form, of an ignition control system constructed according to the present invention.

DETAILED DESCRIPTION

Referring now to the drawing, reference numeral 10 generally designates a gas-fired appliance, such as a furnace, having a heat exchanger generally designated 11, below which there is located a burner 12 supplied by a source of gas, and including at least one valve 13. A second valve 14 may also be used, in the case of ignition by means of a pilot, or it may be a redundant valve leading to the main burner.

In either case, the valve 13 leading to the burner is controlled (but not illustrated in the drawing as being mechanically interconnected) by a Fuel and Ignition Control circuit functionally illustrated by the block 15. The circuit 15 may be any one of a number of commercially available control circuits, for example that sold under the designation Model G60 by the Control Products Division of Johnson Controls, Inc. of Milwaukee, Wis. which includes a ground-interrupt lead 17, a power lead 18, and a control lead 19. This unit permits electrical interruption of the lead 17 leading to ground, and it is designed for fuel ignition only upon a call for heat, although the invention has broad applicability to pilot ignition, direct ignition and standing pilot systems. An input transformer T is used to supply electrical power from a conventional 60 Hertz line, having its secondary (24 VAC) fused at F and connected between the lead 18 and ground, as illustrated.

A flue pipe generally designated 20 connects the furnace 10 to the chimney, and in this connection, the term "stack" is used herein to generically refer not only to the chimney, but to all flue pipes leading to it from the furnace. Located in the flue (or other portion of the stack) is a damper generally designated 22. It includes a damper plate 23 shown in the full open position in solid line and in the full closed position in dashed line, as indicated by reference numeral 23A.

In this embodiment, the damper plate moves back and forth between the open and closed positions, actuated by a linkage including an arm 24 and a pusher member 25. Alternately, the damper motors could be connected to oscillate a shaft 26 on which the damper plate is mounted. In the illustrated embodiment, the pusher rod 25 is actuated by motor means generally designated 30 and including a "Run Open" motor 31, and a "Run Close" motor 32. The motors 31, 32 are arranged to rotate in opposite directions, when actuated. They may be a Synchron Series 600 Reversible Clock Motor, manufactured by Hansen Mfg. Co., Inc., of Princeton, Ind.

A pair of limit or end switches designated S1 and S2 are mounted to be actuated when the damper plate 23 is in the full open and full closed positions respectively. The switch S1 has associated with it a normally closed contact designated S1/NC, and a normally open contact designated S1/NO. Similarly, the switch S2 has associated with it a set of normally closed contacts S2/NC and a set of normally open contacts S2/NO.

The contacts S1/NC are connected between one terminal of the Run Open motor 31 and ground (or common). The contacts S2/NC are connected between a common junction 33 of the lead 17 of the Fuel and Ignition Control circuit 15 and the ground terminal of the Run Closed motor 32 and ground.

The other terminals of the motors 31, 32 are connected respectively to the fixed contacts of a Draft Controller generally designated 35, the fixed contacts of its switches being designated 36, 37 respectively. The Draft Controller 35 also includes a movable switch contact 38, having a distal end located in a conventional magnetic detent 39 to achieve a snap action in making connection with either of the contacts 36 or 37. The movable switch contact 38 of the Draft Controller is connected to a diaphragm 41 of a pressure sensing transducer generally designated 42.

The sensor 42 includes a housing 43 in which the diaphragm 41 is connected to define two chambers designated respectively 44, 45. The chamber 45 communicates with the flue 20 by means of a conduit 47 which is coupled to the flue at an opening 48 located between the fire box of the furnace 10 and damper assembly 22.

The other chamber 44 communicates with the ambient atmosphere by means of a port 49. As indicated, the diaphragm 41 is connected to the movable switch contact 38 of the Draft Controller 35 by means of a mechanical linkage diagrammatically illustrated by the dashed line 53.

The pressure sensing transducer 42, having one side referenced to atmospheric pressure (port 49), and the other side referenced to a location in the flue upstream of the damper assembly (port 48), senses a differential pressure representative of draft—that is, a pressure below atmospheric pressure caused by the flow of hot gases through the flue due to the stack action of the chimney. This pressure differential is converted to a displacement of the diaphragm 41. The Draft Controller 35 is set such that contacts 36 and 38 will be closed if the sensed value of draft is equal to or greater than atmospheric pressure and less than 0.03 inches (hydrostatic pressure below atmospheric), and contacts 38, 37 close if the value of draft is greater than 0.05 inches of pressure (again, below atmospheric). Using the customary definition, "draft" is expressed as a positive number, even though it is a pressure beneath atmospheric; and it is measured as the absolute value of the magnitude of pressure beneath atmospheric pressure. If the value of draft is between 0.03 and 0.05 inches, the movable contact 38 does not engage either of the fixed contacts 36, 37. To summarize the action of the Draft Controller 35, one set of contacts (36, 38) is closed if draft is less than 0.03 inches, and the other set of contacts (37, 38) closes if the value of draft exceeds 0.05 inches. The difference between these two levels of draft defines a predetermined normal operating or design range in which the damper is not operated. If draft falls below the 0.03 inch level during a normal operating cycle, as will be further explained, the damper is opened to increase the draft; and if draft exceeds the 0.05 inch level, the damper is closed to reduce the draft.

The operating levels of draft just mentioned, as well as the values defining the predetermined range may be varied by employing a draft controller switch of the type disclosed in my U.S. Pat. No. 4,239,477 for Furnace Ignition System with Draft Control and Loss-of-Draft Protection, granted Dec. 16, 1980. This predetermined or design range is important because each furnace manufacturer specifies a preferred draft value for operating his furnace, and efficient operation of the furnace can be achieved if the manufacturer's specified draft value is within the predetermined normal operating range for the Draft Controller 35.

Turning now to the circuit portion of the diagram, a coil 50 of a holding relay R1 is connected in series with a diode D1 and conventional thermostat contacts THS of a thermostat located in the room to be heated. The other terminal of the contacts THS is connected to the secondary of the transformer T via fuse F. The other terminal of the coil 50 is connected to a junction 51. Normally closed contacts 4R3 and a set of normally open contacts S2/NO are connected in series between ground and the junction 51. Relay R1 has three sets of contacts: 1R1(NC), 2R1(NO) and 3R1(NO). Contacts 1R1(NC) are connected between the secondary of transformer T and the Run Close motor 32. Normally open holding contacts 2R1 are connected between the junction 51 and ground across the series circuit described above. Contacts 3R1(NO) are connected between THS and a junction 53, to be further described. Conventional voltage limiting capacitors are connected across all relay coils.

A coil 52 of a relay R2, sometimes referred to as the "enabling" relay (one of its functions is to enable an electronic timer which defines a "trial-for-draft" time period) is connected in series with the thermostat contacts THS (via diode D1) and normally open contacts S1/NO, actuated by the end switch S1. The other terminal of the contacts S1/NO is connected to ground.

The enabling relay R2 has two sets of contacts associated with it, 1R2(NC) and 2R2(NO). They are mechanically tied together so that contacts 2R2 close when contacts 1R2 open.

Contacts 1R2 are connected in series with a resistor 54 and a diode D2 between the junction 53 and a junction 57 which forms the input of an electronic timer circuit generally designated 58. The timer circuit includes a capacitor C2, connected between the junction 57 and ground. The size of the capacitor C2 defines the time period for the trial-for-ignition period, typically in the order of about 30 seconds.

Two sets of normally open contacts, 2R2 and 3R3, are connected in parallel. One terminal of this parallel combination is connected to the previously described input junction 57, and the other terminal is connected to a resistor 59 to the input of a Darlington transistor pair 60.

The emitter of the Darlington pair 60 is grounded, and the collectors of the pair are connected to a coil 62 of a relay R3. The principal functions of the relay R3 are to enable the Fuel and Ignition Control 15, and to enable the Draft Controller 35 to take over control in operating the motors 31, 32. The relay R3 has five sets of contacts: 1R3(NO), 2R3(NC), 3R3(NO), 4R3(NC) and 5R3(NO). The contacts 1R3 and 2R3 are mechanically tied together, and they are also electrically connected in series, the junction between them being connected to the junction 53. The other terminal of the contacts 1R3 is connected to contacts 5R3, the other contact of which is connected to the enable lead 19 of the Fuel and Ignition Control Circuit 15. The junction between contacts 1R3 and 5R3 is directly connected to the movable contact 38 of the Draft Controller 35. The contacts 3R3 and 4R3 have already been described.

The other terminal of coil 62 of relay R3 (that is, the one not connected to the collectors of the Darlington pair 60) is connected via a resistor 65 to the diode D2, and through a storage capacitor C1 to ground, as illustrated in the drawing.

A transfer relay R4 has a coil 70 connected via a diode D3 to the contacts THS. The other terminal of the coil 70 is connected to the junction 33. The relay R4 has two sets of contacts: 1R4(NO) and 2R4(NC). These sets of contacts are connected together, and the junction between them is connected to the contacts 2R3. The other terminal of contacts 1R4 is connected to the junction between the run open motor 31 and the fixed contact 36 of the Draft Controller 35. The other terminal of contacts 2R4 is connected to a lead 73 which couples the contacts 1R3 to the movable contact 38 of the Draft Controller 35.

OPERATION

When the thermostat contacts THS are open, indicating that heating requirements have been satisfied, under normal operating conditions, the coil 50 of the holding relay R1 is de-energized, and the Run Close Motor 32 will have been actuated through normally closed contacts 1R1 and S2/NC to rotate the damper plate 23 to the fully closed position 23A, which time the switch S2 is actuated and the contacts S2/NC are opened, to de-energize the motor 32. Interlocking contacts S2/NC with the ground lead 17 insures that the Fuel and Ignition Control Circuit 15 cannot be energized when the damper plate is in the closed position.

When the thermostat generates a call for heat signal, by closing the contacts THS, the coil 50 of the holding relay R1 is energized through normally closed contacts 4R3, provided the switch S2 is actuated, indicating that the damper plate is closed. It is considered an important safety feature of the illustrated system that an operating cycle cannot commence unless the damper plate is in the closed position. This insures that the system will have operated a complete cycle, testing all major operating elements of the system, both mechanical and electrical.

When the coil 50 is energized, contacts 2R1 close, thereby holding the relay R1 energized until the contacts THS open, when the heat requirements have been satisfied. At the same time, contacts 3R1 close, thereby communicating power from the secondary of transformer T to the junction 53 between sets of contacts 1R3 and 2R3, associated with the ignition enabling relay R3. Power is coupled from the junction 53 through diode D2 to the electronic timer circuit 58 as soon as contacts 3R1 close. Because relay R2 is disabled at this time, capacitor C2 begins to charge immediately through resistor 54 and normally closed contacts 1R2. Further, because the Darlington pair 60 is non-conducting at this time, storage capacitor C1 charges to the full line voltage. The value of resistor 65 is set such that capacitor C1 must be charged to the full line voltage when the Darlington pair 60 conducts, or relay R3 will not pull in. In other words, if the capacitor C1 is not charged to the full line voltage and the Darlington pair 60 should conduct, the resistor 65 will limit current through the coil 62 of relay R3 to a low value insufficient to actuate the relay and cause its contacts to transfer. This is a safety feature in that if the end switch S1 is stuck in its actuated position, and relay R2 is energized before the damper is fully opened, the timer circuit 58 will not be energized, and thus the Fuel and Ignition Control Circuit 15 also cannot be energized.

Assuming that all components are operating properly, when the relay R1 is energized, power is fed through the contacts 3R1, via junction 53, normally closed contacts 2R3 and normally closed contacts 2R4 to the movable contact 38 of the Draft Controller 35. Since at this time the damper plate 23 is in the full closed position 23A, there is no draft to be sensed, and the movable contact 38 engages the fixed contact 36. With the draft switch thus closed, the Run Open Motor 31 is energized because normally closed contacts S1/NC have not yet been actuated. Further, it will be appreciated that while the damper plate is in the full closed position, switch S2 is actuated so that normally closed contacts S2/NC are open and the transfer relay R4 is de-energized. As soon as the damper plate moves from the full closed position to an extent that the limit switch S2 becomes de-actuated, the contacts S2/NC close, thereby energizing the coil 70 of relay R4 and also providing a ground to the ground lead 17 of the Fuel and Ignition Control Circuit 15. When the transfer relay R4 is energized, its contacts actuate, and whereas contacts 2R4 open, contacts 1R4 close, thereby continuing to supply power to the Run Open Motor 31.

The Run Open Motor 31 remains energized until the damper plate reaches the full open position at which time limit switch S1 is actuated, and contacts S1/NC open to de-energize the run open motor. At the same time, normally open contacts S1/NO close to energize the coil 52 of relay R2.

When the enable relay R2 is energized, contacts 1R2 open to isolate the capacitor C2 from the power source, and contacts 2R2 close, coupling the capacitor C2 to the input of the Darlington pair 60, thereby causing it to conduct. When the Darlington pair 60 conducts, the storage capacitor C1 will have been charged to full line voltage, and current will flow through the coil 62 of the relay R3 in sufficient magnitude to cause its contacts to transfer. A sustaining current is provided for relay R3 via resistor 65 as long as the Darlington pair 60 is in a conducting state, the period of which is determined by the value of the capacitor C2, and, as indicated, normally of the order of 30 seconds. In summary, when all components of the system are operating properly, the relay R3 is energized for a predetermined period of time which is referred to as the "trial-for-draft".

At the commencement of the "trial-for-draft" period, the contacts 3R3 close in parallel with contacts 2R2 because relay R2 will become de-energized when the damper plate moves off the full open position and limit switch S1 is de-actuated. This will not happen, however, unless draft is sensed of a magnitude sufficient to cause movable contact 38 to engage fixed contact 37 of the Draft Controller 35 to energize the Run Close Motor 32. If, for example, there is an obstruction in the exhaust flue, the electronic timer 58 will time out when the charge on capacitor C2 is depleted and the Darlington pair 60 switches to a non-conducting state. This will cause relay R3 to de-energize to lock the system out.

Returning now to normal operation when all system components are operating properly, when relay R3 becomes energized, contacts 1R3 and 5R3 close to couple power to the control input lead 19 of the Fuel and Ignition Control Circuit 15 which then opens the valve to couple fuel to the burner 12, and also initiates an ignition cycle. At the same time, power is coupled via lead 73 to the movable contact 38 of the Draft Controller 35.

When the damper reaches the full open position during a start-up cycle, the temperature difference between the ambient and the outside will establish a draft due to stack action of the chimney. This draft will normally be increased when the fuel is ignited. This draft is sensed through the opening 48 and communicated to the pressure sensing means 42 through conduit 47. Because the damper plate is fully open when the flame is first ignited, a draft will be produced which is greater than the normal operating range defined by the Draft Controller 35, and the contacts 38, 37 will close. This will generate a "Run Close" signal to energize the Motor 32, and thereby cause the damper plate to run toward the closed position until draft falls below the higher predetermined level defining the desired draft range (which in the exemplary embodiment is a 0.05 inch level). At this time, the contacts 37, 38 disengage, and the Run Close Motor 32 is de-energized, leaving the damper plate in an intermediate position between fully open and fully closed.

If no draft has been sensed (blocked passage of flue gas), the damper plate does not move off the full open position, S1 remains actuated, the electronic trial-for-draft signal disappears since Relay R2 remains energized. When the trial-for-draft signal does terminate, relay R3 drops out, the Fuel and Ignition Control Circuit 15 is de-energized and the system locks out until reset.

During a normal operating cycle, the damper plate will be at the full open position only momentarily and the Run Close Motor 32 will be energized before the trial-for-draft signal terminates—that is, before the charge on capacitor C2 reduces to a value at which it is unable to sustain the Darlington pair 60 in a conducting state. As the damper is driven toward the closed position, the draft is decreased and this is sensed by transducer 42 immediately. Typically, when the damper is half closed, the sensed draft will be less than the higher predetermined value (0.05 in.) and the Run Close Motor 32 will be de-energized.

When a call for heat has been satisfied, the contacts THS open, thereby de-energizing the coils of relays R1, R2 and R3 simultaneously, and when relay R1 is de-energized, contacts 1R1 close to generate a "Run Close" signal to energize Motor 32 through contacts S2/NC until the damper plate is fully closed and the switch S2 is actuated. The system is then at rest and prepared for another complete operating cycle.

It will be observed from the above that during a normal operating cycle, the damper plate must be in the closed position to start a cycle, and be run to a fully open position before fuel can be supplied to the appliance.

If draft is lost during an operating cycle, then the contacts 36, 38 close to energize the Run Open Motor 31 until the damper plate reaches the fully open position, at which time the Motor 31 is de-energized by the opening of the contacts S1/NC. At the same time, the contacts S1/NO close, thereby energizing relay R2 which, in turn, energizes the electronic timer 58 to commence a new trial-for-draft period. If draft is not sensed within the new period, relay R3 falls out, thereby de-actuating the Fuel and Ignition Control Circuit 15 and shutting off the flow of fuel to the burner. The system locks out until it is re-cycled. This may be accomplished externally, or by including a reset switch, or by cycling the thermostat control.

The present system thus eliminates any need for a draft hood because draft is controlled directly by controlling the position of the damper plate 23. Further, more efficient operation of the furnace is provided by controlling the value of draft which controls the flow of air through the fire box. The system also provides loss-of-draft safety, as just explained. Still further, the system closes the damper plate 23 when the furnace is off, to eliminate any vent losses during off cycles. All of these features are provided in a system which is safe not only in normal operation, but which does not create any unsafe condition even though one or more components may fail.

The function of relay R2 could be equivalently performed by a second, similar end switch, S1, positioned to operate simultaneously with or slightly before end switch S1 of the illustrated embodiment. In other words, the added end switch would have single-pole, double-throw contacts replacing contacts 1R2 and 2R2 in the timer circuit of the illustrated embodiment. Similarly, an end switch similar to end switch S2 of the illustrated embodiment and positioned or structured to operate simultaneously with or slightly before the described end switch S2 could replace the transfer relay R4, again having single-pole, double-throw contacts replacing the contacts 1R4 and 2R4 of the illustrated embodiment when contacts S2/NC of the illustrated embodiment close.

SAFETY FEATURES

Because the present invention is intended primarily for residential use, complete safety and economy are two very important considerations. Interlocking of the holding relay R1 and the timer enabling relay R2 with the normally open contacts of the damper switches S1 and S2 respectively, insures that the damper plate is in the fully closed position prior to the initiation of any portion of the cycle. This tests all of the primary electrical and mechanical elements for operativeness at the end of each heating cycle. Further, the damper plate must be moved to the fully open position before a trial-for-ignition period commences. Fuel is fed to the burner and ignited with the draft switch in the full open position. Still further, an actual draft must be sensed by the Draft Controller 35 within the trial-for-draft period as generated by the electronic timer, or the system will shut down and lock out. An exhaustive analysis of various failure modes indicates that all conceivable realistic faults will result in either (1) continued safe normal operation during a current heating cycle followed by a failure to re-start in the subsequent heating cycle; (2) an immediate safe shut down; or (3) a safety lock out after an initiated trial-for-draft timing sequence.

Although welded relay contacts are not usually contemplated in a failure mode analysis, the present invention provides the following failure modes in such events. If the contacts of relay R3 weld closed, contacts 4R3 are held open. In this condition, the system will not re-start because relay R1 cannot be energized. If the contacts of relay R1 weld closed, at the end of a normal heating cycle, contacts 1R1 cannot close and the damper will remain in the same position it had at the end of the heating cycle. Thus, contacts S2/NO cannot close, and the system will not start at the next call for heat.

If the contacts of relay R2 weld closed, capacitor C2 cannot charge since contacts 1R2 remain open. Thus, relay R3 cannot be energized, and the system is in a lock out condition.

If the contacts of relay R4 weld closed, there is no detrimental effect, but the system does not prove operativeness of the contacts 36, 38 of the Draft Controller 35.

If limit switch S1 fails to trip at the full open position due to improper adjustment or wear, relay R2 cannot pull in, and contacts 2R2 cannot close so that relay R3 can never be energized, and ignition is prevented.

If end switch S2 fails to trip at the full closed position due to improper adjustment or wear, contacts S2/NO do not close, thereby preventing relay R1 from being energized, and the system cannot start.

Having thus disclosed in detail an embodiment of the invention, persons skilled in the art will be able to modify certain of the structure which has been illustrated and to substitute equivalent elements for those disclosed, such as the examples given, while continuing to practice the principle of the invention. It is therefore intended that all such modifications and substitutions be covered as they are embraced within the spirit and scope of the appended claims.

I claim:

1. In combination with a furnace having a firebox and adapted to be connected to a source of fuel by means of fuel control means, a movable element movable between a closed and an open position for controlling the flow of air through a firebox of said furnace, and a thermostat for generating a call-for-heat signal from a space to be heated by said furnace, the improvement comprising: flue means for communicating combustion gases from said firebox to a chimney and substantially free of losses to the atmosphere between said firebox and chimney; motor means responsive to a run open signal for operating said movable element toward said open position and responsive to a run closed signal for operating said element toward said close position; first limit switch means actuated when said movable element is in said open position; second limit switch means actuated when said movable element is in said closed position; holding circuit means responsive to a call-for-heat signal only when said second limit switch means is actuated for generating an initial run open signal to said motor means; controller means including pressure sensing means responsive to the pressure in said flue means for generating a run open signal when the draft in said flue means is less than a first predetermined value, and for generating a run close signal when the draft in said flue means is greater than a second predetermined value, said controller means generating neither of said signals when the draft is between said first and second predetermined values; electronic timer circuit means responsive to the actuation of said first limit switch means when said movable element is in said open position following a predetermined time interval after said holding means is actuated for generating a timing signal of predetermined duration representative of a trial-for-draft period; first enable circuit means energized by said timer circuit means during said trial-for-draft period for energizing said fuel control means and for enabling said controller means to couple said run open and run close signals to said motor means; said timer circuit means being connected in circuit with said first limit switch to de-energize said first enable circuit means if said controller means senses no draft in said flue means during said trial-for-ignition period.

2. The apparatus of claim 1 wherein said pressure sensing means of said controller means includes switch means having one set of contacts in an actuated position when the draft in said flue means is less than said first pre-determined value, and a second set of contacts in an actuated position when said draft in said flue means is greater than said second predetermined value, said initial run open signal being coupled through said first set of contacts to said motor means thereby establishing that said movable element is in the closed position before commencing a cycle of operation.

3. The apparatus of claim 2 further comprising transfer switching circuit means having first and second states, said transfer switching circuit means being connected in circuit with said second limit switch means so as to remain in said first state when said call-for-heat signal is first generated, but being transferred to said second state when said movable member moves slightly off its closed position, said transfer switching circuit means coupling said initial run open signal through the first set of contacts of said controller means when said movable member is in said closed position and thereafter coupling said initial run open signal directly to said motor means when said transfer switching circuit means is switched to said second state.

4. The apparatus of claim 1 further comprising second enable circuit means connected in circuit with said first limit switch means and receiving said call for heat signal, but remaining de-energized until said movable member reaches said open position and actuates said second limit switch means, said second enable circuit means thereupon generating an enable signal to said timer circuit means to commence said trial-for-draft period, said timer circuit means being continuously energized in response to said movable element's moving off said closed position to de-energize said second enable circuit means and thereby continuously energize said timing circuit means to continue to actuate said first enable circuit means.

5. The apparatus of claim 4 wherein said timing circuit means includes a second switching circuit, said first enable circuit means and current limiting resistor means receiving a signal generated by said holding circuit means in response to a call-for-heat signal; said timing circuit means further including storage capacitor means coupled in circuit with said first enable circuit means and said second switching means such that said storage capacitor means must be charged to a predetermined value before said enable circuit means will transfer, but said current limit resistor means providing sufficient current to permit said holding circuit means to remain actuated once it has been actuated, whereby said storage capacitor must be charged to said predetermined value before said second switching circuit means conducts, in order to actuate said first enable circuit means.

6. The apparatus of claim 5 wherein said second enable circuit means is connected in circuit with said first limit switch means and includes contact means connected in circuit with said timer circuit means to prevent energization of said timer circuit means beyond said trial-for-draft period if said first limit switch means is not de-actuated during said trial-for-draft period by said movable element's moving off said open position.

7. In combination with a furnace having a firebox and adapted to be connected to a source of fuel by means of fuel control means, a damper element movable between a closed and an open position for controlling the flow of air through a firebox of said furnace, and a thermostat for generating a call-for-heat signal from a space to be heated by said furnace, the combination comprising: flue means for communicating combustion gases from said firebox to a chimney and substantially free of losses to the atmosphere between said firebox and chimney; motor means responsive to a run open signal for operating said damper element toward said open position and responsive to a run close signal for operating said damper element toward said closed position; first limit switch means actuated when said damper element is in said open position; second limit switch means actuated when said damper element is in said closed position; holding circuit means responsive to a call-for-heat signal only when said second limit switch means is actuated for generating an initial run open signal to said motor means; controller means including pressure sensing means responsive to the pressure in said flue means for generating a run open signal when the draft in said flue means is less than a first predetermined value, and for generating a run close signal when the draft in said flue means is greater than a second predetermined value, said controller means generating neither of said signals when the draft is between said first and second predetermined values; timer circuit means responsive to said damper element's reaching said open position for generating a trial-for-draft signal of predetermined duration, said trial-for-draft signal being of greater magnitude only if said timer circuit means is actuated a predetermined time after said holding circuit means is actuated; and enabling circuit means responsive only to said trial-for-draft signal of said greater magnitude for communicating said call-for-heat signal to said fuel control means and for coupling said controller means in operative relation with said motor means, said timer circuit means including means responsive to said damper element's moving off said closed position to sustain said trial-for-draft signal beyond said predetermined period and thereby continue to energize said enabling circuit means.

8. The apparatus of claim 7 wherein said timer circuit means generates said trial-for draft signal of said increased magnitude only if there is a delay of predetermined duration between the generation of said call-for-heat signal and the triggering of said timer circuit means, said delay being representative of the time for said damper element to move between said closed position and said open position.

* * * * *